United States Patent [19]

Pinto et al.

[11] Patent Number: 4,620,964

[45] Date of Patent: Nov. 4, 1986

[54] PROCESS FOR THE TREATMENT OF COMPLEX MANGANESE ORES, SUCH AS MARINE NODULES

[75] Inventors: Odile Pinto, Neudon; Henri Scoazec, Gif sur Yvette, both of France

[73] Assignee: Commissariat a l'Energie Atomique, Paris, France

[21] Appl. No.: 742,003

[22] Filed: Jun. 6, 1985

[30] Foreign Application Priority Data

Jun. 7, 1984 [FR] France ..... 84 08924

[51] Int. Cl.[4] ..... C01G 3/12; C01G 51/00; C01G 53/11

[52] U.S. Cl. ..... 423/27; 423/37; 423/41; 423/42; 423/45; 423/50; 423/52; 423/140; 423/146; 423/150; 423/DIG. 4; 75/108; 75/115; 75/117; 75/119

[58] Field of Search ..... 75/115, 117, 119, 108, 75/109; 423/36, 27, 41, 37, 45, 42, 52, 50, 140, 146, 150, DIG. 4

[56] References Cited

U.S. PATENT DOCUMENTS

| | | | |
|---|---|---|---|
| 2,450,870 | 10/1948 | Daugherty | 423/50 |
| 2,539,823 | 1/1951 | Furman et al. | 423/50 |
| 3,018,234 | 1/1962 | Litt | 204/83 |
| 3,085,875 | 4/1963 | McCarroll | 75/101 R |
| 3,169,856 | 2/1965 | Mero | 75/119 |
| 3,723,095 | 7/1970 | Skarbo | 423/DIG. 4 |
| 3,810,827 | 5/1974 | Kane et al. | 204/105 M |
| 3,906,075 | 9/1975 | Menz | 423/150 |
| 3,923,615 | 12/1975 | Kane et al. | 204/105 M |
| 4,029,733 | 6/1977 | Faugeras et al. | 423/150 |
| 4,046,851 | 9/1977 | Subramanian et al. | 423/41 |
| 4,065,542 | 12/1977 | Subramanian et al. | 423/DIG. 4 |

FOREIGN PATENT DOCUMENTS

| | | |
|---|---|---|
| 1077725 | 5/1980 | Canada . |
| 2098454 | 3/1972 | France . |
| 2492844 | 4/1982 | France . |
| 2533587 | 3/1984 | France . |

*Primary Examiner*—John Doll
*Assistant Examiner*—Robert L. Stoll
*Attorney, Agent, or Firm*—Michael N. Meller

[57] ABSTRACT

A process for the treatment of a complex manganese ore, wherein it comprises the following stages:

(a) crushing the ore, (b) subdividing the crushed ore into a first part and a second part, (c) preparing the first pulp from the first part of the crushed ore, (d) reacting the first pulp with a reducing agent to obtain a manganous sulphate solution, (e) separating the liquid phase constituted by the thus obtained manganous sulphate solution from the solid phase of the thus treated first pulp, (f) preparing a second pulp from the second part of the crushed ore, (g) subjecting the second pulp to a solubilization treatment of the nickel, copper and cobalt by reacting it hot with sulphuric acid and the manganous sulphate solution obtained in stage (e), (h) separating the liquid phase and the solid phase of the thus treated second pulp, and (i) recovering the nickel, copper and cobalt from the liquid phase separated in stage (h).

20 Claims, 1 Drawing Figure

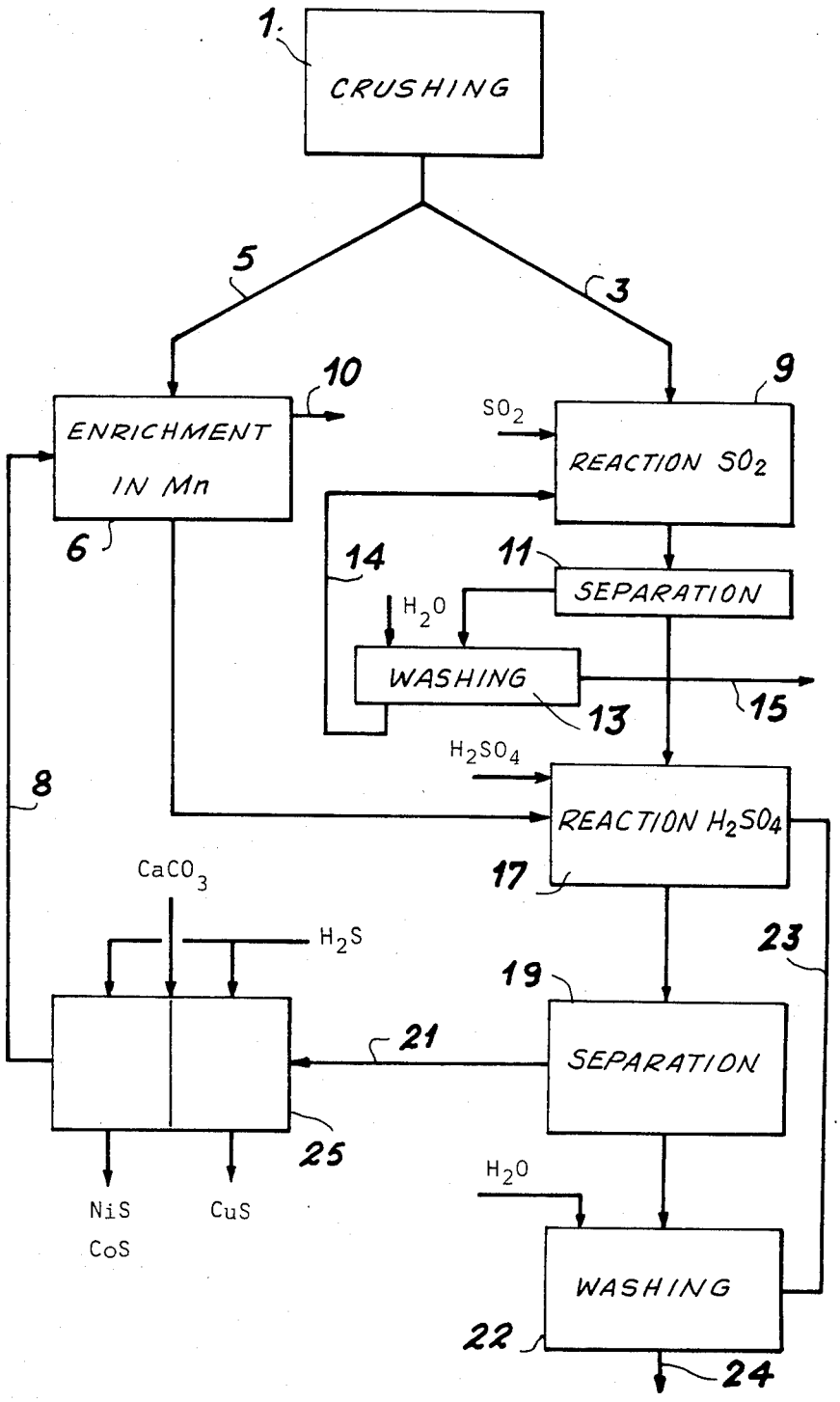
1
CRUSHING
5
3
10
9
ENRICHMENT IN Mn
SO2
REACTION SO2
6
14
11
SEPARATION
H2O
WASHING
13
15
H2SO4
8
REACTION H2SO4
17
CaCO3
H2S
23
19
21
SEPARATION
25
H2O
NiS
CoS
CuS
WASHING
22
24

PROCESS FOR THE TREATMENT OF COMPLEX MANGANESE ORES, SUCH AS MARINE NODULES

BACKGROUND OF THE INVENTION

The present invention relates to a process for the treatment of complex manganese ores, such as manganiferous nodules found on the ocean bed.

More specifically, it relates to a process making it possible to extract with high yields nickel, copper and cobalt present in manganiferous nodules and to regulate to the desired value the manganese quantity extracted from the treated nodules.

Such manganiferous nodules contain large amounts of manganese and iron, smaller amounts of nickel, cobalt and copper and small quantities of other elements. Nickel, copper and cobalt are high value metals, which are worth extracting from said nodules with higher yields, in view of the fact that there are significant decreases in the known reserves of such metals. Among these, cobalt is particularly difficult to extract by conventional processes in such a way as to give high yields, without simultaneously obtaining a significant solubilization of the manganese.

Thus, according to the process described in French Pat. No. 2,156,079, there is a simultaneous solubilization of manganese, nickel, copper and cobalt by subjecting the nodules to a reduction stage by hot sulphurous anhydride and to a leaching stage by cold sulphuric acid.

In the same way, in U.S. Pat. No. 3,169,856, which describes a process which once again comprise two stages, including a first reduction stage by cold sulphurous anhydride for solubilizing the manganese, nickel and copper and a second stage of leaching the remaining solid phase with an acid in order to recover the cobalt, it is not possible to regulate the manganese quantity dissolved and to have good cobalt yields.

Thus, although manganese is a worthwhile metal, it is not always desirable to recover all the manganese present in the treated nodules.

Thus, numerous studies propose a selective recovery of the nickel and copper, by sulphuric leaching at temperatures below 100° C. In accordance with what has been stated hereinbefore, cobalt is not extracted to any great extent by this process. To obviate this disadvantage, other research has been carried out and would appear to show that in a sulphuric medium, leaching in an autoclave at high pressure and temperature (250° C.) constitutes the only method for the selective solubilization of nickel, copper and cobalt with good yields.

Thus, the objectives of the present invention includes that of providing a novel and improved process for extracting precious metals from complex ores or manganese nodules or any other metal, e.g. containing a manganese oxide matrix.

Another objective is to provide a novel, improved process for extracting cobalt, which may also make it possible to recover nickel and copper elements with excellent yields.

Another objective is to provide a novel process making it possible to selectively extract cobalt, nickel and copper in a sulphuric medium and with good yields, without solubilizing the iron.

Another objective is to provide a novel process making it possible to extract in a sulphuric medium the cobalt, apart from the nickel and copper with good yields and without solubilizing the manganese.

Another objective is to provide a novel process making it possible to extract cobalt, nickel and copper with good yields and without solubilizing the iron, without solubilizing the manganese and without leaching conditions which are as severe as sulphuric leaching in an autoclave at 250° C.

French Pat. No. 2,098,454 has shown that the presence of manganous ions in an ammoniac leaching solution permits an effective solubilization of the nickel and copper. It is also stated that the presence of manganous ions facilitates the recovery of cobalt and molybdenum. It is assumed that in an ammoniac medium, the manganese dioxide is reduced by the manganous ions.

In another French Pat. No. 2,156,079, which relates to the solubilization of nickel, copper, cobalt and manganese contained in nodules, it is stated that during a reducing leaching of nodules by $SO_2$, the presence of manganous sulphate has a favourable effect on the nickel, copper and cobalt yields.

However, in the latter case, there is a reduction of the manganese of the nodules with solubilization of the said manganese, which constitutes a disadvantage because processes are being sought which do not involve the solubilization of the manganese.

The object of the present invention is a process for the treatment of complex manganese ores, such as manganiferous nodules obtained from the ocean bed and which obviates the said disadvantage.

SUMMARY OF THE INVENTION

The process according to the invention for the treatment of a complex manganese ore, such as manganiferous nodules, comprises the following stages:

(a) crushing the ore, (b) subdividing the crushed ore into a first part and a second part, (c) preparing the first pulp from the first part of the crushed ore, (d) reacting the first pulp with a reducing agent to obtain a manganous sulphate solution, (e) separating the liquid phase constituted by the thus obtained manganous sulphate solution from the solid phase of the thus treated first pulp, (f) preparing a second pulp from the second part of the crushed ore, (g) subjecting the second pulp to a solubilization treatment of the nickel, copper and cobalt by reacting it hot with sulphuric acid and the manganous sulphate solution obtained in stage (e), (h) separating the liquid phase and the solid phase of the thus treated second pulp, and (i) recovering the nickel, copper and cobalt from the liquid phase separated in stage (h).

In the present solution, in the nickel, copper and cobalt solubilization stage (g), use is made of manganous ions from the manganous sulphate solution obtained in stage (e), under conditions such that these $Mn^{2+}$ ions cannot act as a $MnO_2$ reducer and in which the medium has no manganese dioxide reducer.

It is demonstrated in the invention that manganous ions in a sulphuric medium make it possible to extract cobalt with a good yield, whilst improving the nickel and copper yields, under operating conditions where sulphuric acid alone only give moderate yields, particularly with regards to cobalt. It is assumed that in this case it is the question of a complex equilibrium involving the intervention of an oxidation-reduction mechanism between on the one hand the dissolved cobalt and the manganese of the ore or nodule and on the other hand the cobalt absorbed or trapped in the manganese of the ore or nodules and the dissolved manganese. Through adding $Mn^{2+}$ ions to the sulphuric leaching solution, it is possible to enrich said solution and consequently displace the equilibrium in favour of the cobalt solubilization.

In the same way, the nickel and copper yields are favourably influenced, probably due to to the ion exchnge phenomena existing in the presence of manganous ions.

According to a preferred embodiment of the inventive process, the second part of the crushed ore is enriched in manganese before subjecting it to the solubilization treatment of the nickel, copper and cobalt.

To this end, the second part of the crushed ore is brought into contact with a manganous sulphate solution in order to fix said crushed ore at least one part of the manganese of said solution and to thus enrich with manganese the crushed ore. Advantageously, the manganous sulphate solution is saturated with $H_2S$.

In addition, preferably, when successively treating several ore batches, the manganous sulphate solution used, is the $H_2S$ saturated solution obtained at the end of stage (i) of the treatment of the preceding batch. Furthermore, on successively treating a first batch and a second batch of crushed ore, the manganous sulphate solution used for the manganese enrichment of the second part of the crushed ore from the second ore batch is constituted by the solution obtained after recovering the nickel, cobalt and copper at the end of stage (i) of the treatment of the first ore batch.

Thus, during stage (i), the nickel, cobalt and copper are generally separated from the liquid phase by precipitation of the corresponding sulphides by means of $H_2S$ and after separating these precipitates, at the end of the treatment, a $H_2S$-saturated manganeous sulphate solution is obtained, which can be reused for the treatment of the following ore batch.

This manganous sulphate solution has a manganous sulphate content well below that which has to be used for performing stage (g). Furthermore, it would have been necessary to concentrate it in order to be able to use it in stage (g), but concentration by evaporation is excluded due to the high energy costs involved.

According to the invention, another method has been developed for recycling the manganous sulphate solution obtained at the end of treatment. This method utilizes an oxidation-reduction mechanism making it possible to concentrate manganous ions in the form of $Mn_2O_3$ by reacting with the manganese dioxide present in the complex manganese ore, followed by a dismutation mechanism of $Mn_2O_3$ into $Mn^{2+}$ by passing into an acid medium during stage (g) of the sulphuric acid solubilization treatment.

Thus, for pH values of approximately 6 to 7, the manganous ions are oxidized by manganous oxide $MnO_2$ of the complex ore or $Mn_2O_3$ nodules in accordance with the following reaction diagram:

$$Mn^{2+}+MnO_2+H_2O \rightleftharpoons Mn_2O_3+2H^+$$

Knowing that a manganiferous nodule generally contains 29% of manganese essentially in the $MnO_2$ state, the oxidation of a manganous sulphate solution at pH values of 6 to 7 can be envisaged. However, there is a saturation threshold of the manganese nodule, which is a function of the manganous ion concentration and the pulp ratio, i.e. the ratio of the mass of solution to the mass of crushed nodules.

During stage (g) of the treatment of the second pulp by hot sulphuric acid, resolubilization takes place of part of the manganous ions previously fixed to the nodules by dismutation of $Mn_2O_3$ into $Mn^{2+}$ and $MnO_2$. However, the presence of certain ions can partly or totally inhibit said dismutation reaction and the solubilization yields obtained do not make it possible to redissolve the total quantity of previously fixed manganous ions, no matter what the temperature and quality of the sulphuric acid used in this stage.

Nevertheless, this recycling mode makes it possible to reuse part of the manganous sulphate discharged at the end of stage (i) and to obtain at the end of stage (h) a manganese-enriched solid phase and on the basis of this it is possible to recover the desired manganese quantity.

According to a variant of the performance of the process according to the invention, usable in the case where the manganous sulphate solution obtained at the end of the treatment is not recycled during the production of the second pulp, the second part of the crushed ore undergoes a sulphuric acid washing stage at ambient temperature, in order to eliminate most of the alkaline elements and alkaline earth elements, the solid phase is separated from the liquid washing phase and said second pulp is prepared from the thus separated solid phase.

On carrying out a recycling of the manganous sulphate solution, the performance of said preliminary sulphuric acid washing stage is not necessary, because most of the alkaline and alkaline earth elements are eliminated during the contacting of the crushed ore with the manganous sulphate solution.

According to the invention, stage (d) involving the preparation of a manganous sulphate is carried out by reacting the first pulp with a mineral or organic reducing agent of a suitable nature, such as $SO_2$, $H_2S$ carbohydrates and alcohols. Preferably, said stage is performed by reacting the first pulp with sulphurous anhydride.

However, it is also possible to carry out said stage by reacting the first pulp with sulphuric acid in the presence of an organic reducing agent, which is e.g. constituted by a carbohydrate such as saccharose, other saccharides such as monosaccharides, oligosaccharides and polysaccharides, an alcohol, a polyalcohol or urea.

In this case, the organic reducing agent is used for reducing the manganese from oxidation state IV to oxidation state II. Thus, it is possible to solubilize the manganese, which requires the consumption of sulphate ions and consequently the consumption of sulphuric acid. Therefore, the pH of the pulp increases and, as a function of the sulphuric acid quantity initially present and the organic agent quantity added to the pulp, it is possible to increase the pH-value of the solution until the pH necessary for precipitation is obtained, in the form of iron hydroxide, from the solubilized ion from the ore. However, if this increase is significant, there is also a precipitation of the solubilized copper from the ore.

It is preferable to use quantities of sulphuric acid and organic reducing agent such that the precipitation pH of the iron (substantially 2) is reached without reaching the precipitation pH of the copper (substantially 4 to 5).

For obtaining the precipitation of all the iron present in the nodules, preference is given to the use of a powerful organic reducing agent, e.g. an agent having several reducing functions, such as saccharides and polysaccharides. Preference is given to the use of saccharose.

In this case, the saccharose quantities generally used are below 500 kg/tonne of ore or treated nodules and is advantageously 200 to 400 kg/tonne of ore or treated nodules. The sulphuric acid quantity used is preferably 700 to 850 kg/tonne of ore or treated nodules if it is wished to dissolve nickel, copper or cobalt and manganese with a yield reaching substantially 100%, if not it is possible to use smaller quantities. The best results are obtained when using 327 kg of saccharose and 850 to 800 kg of sulphuric acid per tonne of ore or nodules. It is pointed out that the solubilization of the manganese requires 500 to 550 kg of sulphuric acid, so that there are 200 to 250 kg of acid for the other elements.

When the reducing agent is constituted by methyl alcohol or ethyl alcohol, it is advantageous to use 100 to 700 kg of alcohol per tonne of treated ore and 700 to 850 kg of sulphuric acid per tonne of treated ore.

At the end of this stage, a manganous sulphate solution is obtained, which also contains nickel, copper and cobalt present in the treated ore. This solution can be directly used for stage (g), which consists of subjecting the second pulp to a solubilization treatment of the nickel, copper and cobalt by reacting with sulphuric acid.

DESCRIPTION OF THE DRAWING AND PREFERRED EMBODIMENTS

Other features and advantages of the invention can be gathered from the following non-limitative description of embodiments with reference to the attached drawing, which is a diagram illustrating the performance of the inventive process for the treatment of manganiferous nodules.

As shown in this diagram, the initial stage consists of crushing (at 1) the manganiferous nodules to an appropriate grain size of e.g. 750 μm. It is pointed out that this grain size is not critical, because the process applies also to higher and lower grain sizes, the grain size variations not having a preponderant influence on the extraction yield of the metals. After crushing, the nodules are separated into two parts, a first part (at 3) which undergoes $SO_2$ leaching to solubilize the manganese and a second part (at 5) which undergoes a solubilization treatment of the nickel, copper and cobalt by $H_2SO_4$. As crushing is carried out in an aqueous medium, the first part is in the form of a pulp and the ratio of the pulp is regulated to the desired value by adding water.

The pulp ratio is defined by the ratio of the soft or sea water mass to the mass of crushed nodules and must be such that the pulp behaves in the same way as a fluid, but is preferably as low as possible in order to be able to treat minimum pulp volumes. Generally, for said first pulp, a pulp ratio from 2 to 5 is used.

The first pulp is then reacted with sulphurous anhydride (at 9) to obtain a manganese sulphate solution, which also leads to the solubilization of the nickel, copper and cobalt present in said first pulp. This reaction is performed at ambient temperature by injecting into the pulp the desired sulphurous anhydride quantity, e.g. by bubbling, whilst maintaining a regular stirring of the pulp. The injected sulphurous anhydride quantity is calculated whilst taking account of the stoichiometry of the sulphating reaction of the manganese dioxide by the sulphurous anhydride, so as to dissolve virtually all the manganese. Generally, a 95% yield is obtained. The solid phase is then separated from the liquid phase (at 11), the solid phase undergoes washing (at 13), whilst recycling (at 24) the wash waters in the reduction stage by $SO_2$. The residual solid phase constituting sterile material is discarded (at 15). It generally contains approximately 5% of the manganese present in the nodules of the first pulp.

The second part 5 of the crushed nodules and which is also in pulp form constitutes the second pulp. It is firstly enriched with manganese in a three-stage installation 6, in which it is countercurrent contacted with a $H_2S$-saturated manganous sulphate solution arriving at 8. During this treatment, the aqueous solution undergoes manganese depletion and is enriched in alkaline and alkaline earth elements from the crushed nodules. This solution is discarded at 10. At the end of this treatment, the second pulp of crushed nodules undergoes the solubilization treatment of the nickel, copper and cobalt carried out in autoclave 17.

As in the case of the treatment by $SO_2$, the pulp ratio must be such that the pulp behaves in the same way as a fluid, but is preferably as small as possible, so that minimum pulp volumes are treated. However, an excessively low pulp ratio limits the copper extraction yield. Generally, a pulp ratio between 2 and 5 is used and preferably a pulp ratio of 2 or 3.

This is followed by the solubilization treatment of the nickel, copper and cobalt by reacting (at 17) said second pulp with sulphuric acid and the manganous sulphate solution from 11 obtained by the $SO_2$ treatment of the first pulp.

The manganous sulphate quantities used for this reaction can vary within a wide range. However, as from a certain threshold, the use of higher quantities leads to no improvement in the results obtained with regards to cobalt extraction.

Generally, the manganous sulphate quantity present in solution during this treatment is 50 to 400 kg/tonne of crushed ore and is preferably 50 to 250 kg/tonne of crushed ore. The $H_2SO_4$ quantity is generally 150 to 500 kg/tonne of crushed ore and preferably 300 to 500 kg/tonne of crushed ore. It can optionally be introduced in such a way that it continuously maintains a slightly acid pH, because this is favourable to the non-solubilization of the iron.

Preferably, the hot solubilization treatment takes place in an autoclave at medium or high pressure, e.g. 7 to 40 bars and at temperatures from 100° to 250° C., preferably 150° to 200° C. and most preferably at 180° C. Generally, the autoclave is preheated to 100° C. using live steam and then the assembly is heated to the desired final temperature using live steam, so as to reach the favourable pulp ratio for good leaching. This temperature is maintained for the desired time, which is generally 1 to 8 hours, which makes it possible to obtain a satisfactory solubilization of the nickel, copper and cobalt. The second pulp leaving the autoclave is then separated (at 19), so as to obtain (at 21) a liquid phase containing more particularly nickel, copper and cobalt. The solid phase then undergoes washing with water (at 22), the washing water being recyclable (at 23), either totally or partly in the autoclave for the solubilization treatment of the copper, nickel and cobalt by sulphuric acid. The washed solid phase 24 is then discarded in the form of sterile material constituting manganiferous residues with a higher manganese content than the initial ore. On the basis of the separated liquid phase (at 21), it is possible to recover by different treatments nickel, copper and cobalt. Generally, this is carried out by precipitation of the corresponding sulphides at 25. Firstly, copper sulphide CuS precipitation takes place by means of $H_2S$ and then the pH of the residual solution is adjusted by calcium carbonate in order to then precipitate the nickel and cobalt sulphides by $H_2S$ action. Following the separation of the precipitates, the solution obtained which contains manganese sulphate, is recycled (at 8) in the preparation stage of the second pulp.

For the performance of the process according to the invention, the crushed nodule quantities respectively subdivided into the first part and the second part of the crushed ore are chosen so as to have the desired manganous sulphate quantity for the solubilization treatment stage of the nickel, copper and cobalt performed on the second pulp. This quantity, which is generally 50 to 250 kg of dissolved manganous sulphate per tonne of crushed ore is provided on the one hand by the $SO_2$ treatment solution of the first pulp and on the other hand by the manganous ions which pass back into sulphuric solution and which result from the manganese enrichment of the ore used for preparing the second pulp.

To obtain the desired manganous sulphate quantity, the ore is generally subdivided into a first part representing 10 to 15% by weight of the treated ore and a second part representing 85 to 90% of the treated ore.

In the example shown in the drawing, one tonne of crushed nodules distributed in the following way are treated: 121 kg for the first part of the nodules and 879 kg for the second part, which corresponds to manganese contents of 35.1 kg for the first part and 255 kg for the second part. During the treatment of the first pulp by $SO_2$, the yield is 95% and 33.3 kg of manganese pass into solution. For the preparation of the second pulp, the enrichment of the ore by recycled manganous sulphate solution leads to a manganese content of 309 kg. During the solubilization treatment by sulphuric acid, 7% of the manganese fixed to the ore of the second pulp passes into solution again and in this way the solubilization treatment by $H_2SO_4$ is performed by using 55 kg of manganese, i.e. 150 kg of manganous sulphate.

At the end of this stage, the recovered solid phase (at 24) has a 35% manganese content, which corresponds to 288.3 kg of manganese.

It is possible to recover the desired manganese quantity from said solid phase, in the form of ferromanganese or silicomanganese, using conventional direct pyrometallurgical treatments following a pelletizing stage.

It is also possible to consider the production of pure metallic manganese or pure $MnO_2$ through passing via a solubilizition stage, e.g. by subjecting to a reduction operation all or part of the recovered solid phase. To this end, it is possible to prepare a pulp from the solid phase and subject it to a reduction using an appropriate reducing agent, such as $SO_2$, $H_2S$, a carbohydrate or an alcohol.

It is in particular possible to react said pulp with sulphuric acid in the presence of an organic reducing agent, such as a carbohydrate or an alcohol.

The following examples illustrate in a non-limitative manner the process of the invention.

EXAMPLE 1

This example illustrates the fixing of the manganese present in a manganous sulphate solution to crushed nodules.

In this example, the crushed nodules are contacted with the $MnSO_4$ solution in countercurrent manner to obtain an autoregulation of the pH by the basicity of the nodule. Thus, the oxidation of the nodules by $Mn^{2+}$ releases an acidity equivalent to the sulphuric acid quantity necessary for the neutralization of the alkaline or alkaline earth metals present in the nodules.

Moreover, countercurrent operation makes it possible to obtain a maximum manganese purification of the solution and a maximum manganese enrichment of the nodule.

This countercurrent contacting takes place in three stages with a manganous sulphate solution containing 25 $g.1^{-1}$ of manganese, a pulp ratio equal to 3 and a residence time of 1 hour in each stage. The results are given in table 1.

Under these conditions, the fixing efficiency of manganese is 71%. The manganese content of the nodule is then 32.6% and the Mn concentration of the discharged solution 7 $g.1^{-1}$.

However, on operating with a manganous sulphate solution containing 25 $g.1^{-1}$ of $H_2S$ saturated manganese, as is the case in the solution recovered at the end of the nodule treatment following the precipitation by $H_2S$, the fixing yield is 84%. The manganese content of the nodule is then 33.2% and the manganese concentration of the discharged solution 5.5 $g.1^{-1}$.

Using under the same conditions an installation having four stages and a pulp ratio of 3 and a manganese content of the manganous sulphate solution of 25 $g/1^{-1}$ or 15 $g.1^{-1}$ saturated with $H_2S$, it is possible to obtain a manganese fixing yield between 82 and 96%.

EXAMPLE 2

This example investigates the dismutation yield of the manganese fixed to the nodules, during the reaction with sulphuric acid in the autoclave and at different temperatures for 2 hours, using different sulphuric acid quantities and a pulp ratio equal to 2. The results obtained and the reaction conditions are given in table 2.

On the basis of the latter, it can be seen that the temperature and sulphuric acid content of the solution have substantially no effect on the solubilization yield and that in all cases it is not possible to resolubilize all the manganous ions fixed to the nodules.

EXAMPLES 3 to 26

In these examples, different treatment conditions are used for carrying out the stage (g) of the solubilization of the nickel, copper and cobalt on the second pulp.

In all cases, the manganous sulphate introduced into the autoclave was produced in part by reducing the first pulp by means of $SO_2$ and partly by redissolving in the autoclave the manganese fraction carried by the manganese-enriched nodules of the second pulp.

Following the solubilization reaction, the solid and liquid phases of the pulp are separated by decanting and the nickel, iron, copper, cobalt and manganese contents of the liquid phase are determined. Results obtained are given in table 3. The figures in brackets therein represent the results obtained under the same conditions, but in the absence of manganous sulphate. On the basis of these results, it can be seen that the presence of manganous sulphate makes it possible to improve to a significant extent the extraction yield for cobalt and it also plays a part with regards to the extraction yields of iron, cobalt, nickel and copper.

EXAMPLE 27

This example illustrates the performance of stage (d) of the preparation of a manganese sulphate solution by treating the crushed ore with sulphuric acid in the presence of saccharose.

After crushing 1 tonne of nodules to a grain size of approximately 750 μm, they are mixed with soft water to form a pulp having a pulp ratio (soft water mass/-crushed nodule mass) equal to 4. This said pulp are then added 750 kg of sulphuric acid and 327 kg of saccharose, after which the pulp is stored. After 2 hours, the solid phase is separated from the liquid phase and the manganese, iron, nickel and cobalt quantities present in the liquid phase are determined.

The results obtained are as follows:

Mn extraction yield: 90%

Fe extraction yield: 3%

Ni extraction yield: 92%

Cu extraction yield: 90%

Co extraction yield: 80%. t,0210 t,0220 t,0230

What is claimed is:

1. A process for the treatment of a complex manganese ore, wherein it comprises the following stages;

(a) crushing the ore, (b) subdividing the crushed ore into a first part and a second part, (c) preparing a first pulp from the first part of the crushed ore, (d) reacting the first pulp with a reducing agent to obtain a manganous sulphate solution, (e) separating the liquid phase constituted by the thus obtained manganous sulphate solution from the solid phase of the thus treated first pulp, (f) preparing a second pulp from the second part of the crushed ore, (g) subjecting the second pulp to a solubilization treatment of the nickel, copper and cobalt by reacting it at a temperature of from 100° to 250° C. at a pressure of 7 to 40 bars with sulphuric acid and the manganous sulphate solution obtained in stage (e), (h) separating the liquid phase and the solid phase of the thus treated second pulp, and (i) recovering the nickel, copper and cobalt from the liquid phase separated in stage (h).

2. A process according to claim 1, wherein the second part of the crushed ore is contacted with a manganous sulphate solution in order to fix to said crushed ore at least part of the manganese of said solution, so as to bring about a manganese enrichment of the crushed ore by reaction of manganous ions with manganese dioxide in the ore to form $Mn_2O_3$.

3. A process according to claim 1, wherein in stage (i), the nickel, copper and cobalt are recovered by precipitating the corresponding sulphides by means of $H_2S$.

4. A process according to claim 2, wherein there is a successive treatment of a first batch and a second batch of crushed ore and wherein the manganous sulphate solution used for the manganese enrichment of the second part of the crushed ore from the second ore batch is constituted by the solution obtained, following the recovery of the nickel, copper and cobalt, at the end of treatment stage (i) of the first ore batch.

5. A process according to claim 1, wherein the second part of the crushed ore undergoes a washing stage using sulphuric acid at ambient temperature, in order to eliminate most of the alkaline and earth alkaline elements, wherein the solid phase is separated from the liquid washing phase and wherein the second pulp is prepared from the thus separated solid phase.

6. A process according to claim 1 wherein the manganous sulphate quantities present in solution in stage (g) is 50 to 250 kg of $MnSO_4$ per tonne of ore subjected to the solubilization treatment.

7. A process according to claim 1, wherein the solubilization treatment of stage (g) is performed at a temperature between 150° and 200° C.

8. A process according to claim 1, wherein the sulphuric acid quantity used in stage (g) is 300 to 500 kg of sulphuric acid per tonne of ore subjected to the solubilization treatment.

9. A process according to claim 1, wherein the first part of the crushed ore represents 10 to 15% by weight of the treated ore.

10. A process according to claim 1, wherein the reducing agent used in stage (d) is sulphurous anhydride.

11. A process according to claim 1, wherein, in stage (d), the first pulse is reacted with sulphuric acid in the presence of an organic reducing agent.

12. A process according to claim 11, wherein the organic reducing agent is a carbohydrate or an alcohol.

13. A process according to claim 12, wherein the carbohydrate is saccharose.

14. A process according to claim 13, wherein the saccharose quantity used is 200 to 400 kg/tonne of ore subjected to the treatment.

15. A process according to claim 11, wherein the sulphuric acid quantity used is 700 to 850 kg/tonne of ore subjected to the treatment.

16. A process according to claim 2, wherein the manganous sulphate quantities present in solution in stage (g) is 50 to 250 kg of $MnSO_4$ per tonne of ore subjected to the solubilization treatment.

17. A process according to claim 2, wherein the solubilization treatment of stage (g) is performed at a temperature between 150° and 200° C.

18. A process according to claim 6, wherein the solubilization treatment of stage (g) is performed at a temperature between 150° and 200° C.

19. A process according to claim 18, wherein the sulphuric acid quantity used in stage (g) is 300 to 500 kg of sulphuric acid per tonne of ore subjected to the solubilization treatment.

20. A process according to claim 12, wherein the sulphuric acid quantity used is 700 to 850 kg/tonne of ore subjected to the treatment.

* * * * *